US009194654B1

(12) United States Patent
Viani

(10) Patent No.: US 9,194,654 B1
(45) Date of Patent: Nov. 24, 2015

(54) WING AND RIDER

(71) Applicant: Arthur J. Viani, Miami, FL (US)

(72) Inventor: Arthur J. Viani, Miami, FL (US)

( * ) Notice: Subject to any disclaimer, the term of this patent is extended or adjusted under 35 U.S.C. 154(b) by 0 days.

(21) Appl. No.: 14/623,060

(22) Filed: Feb. 16, 2015

(51) Int. Cl.
*F41C 27/00* (2006.01)

(52) U.S. Cl.
CPC ..... *F41C 27/00* (2013.01)

(58) Field of Classification Search
CPC ..... F41A 7/00; F41A 99/00; F41A 11/00; F41A 35/00; F41C 27/00; F41C 33/0281
USPC ..... 42/85, 90, 106, 108; 89/1.4
See application file for complete search history.

(56) References Cited

U.S. PATENT DOCUMENTS

| | | | | |
|---|---|---|---|---|
| 1,680,186 | A * | 8/1928 | Von Frommer | 42/106 |
| 5,275,084 | A * | 1/1994 | Ruger | 89/196 |
| 6,775,940 | B2 * | 8/2004 | Dworzan et al. | 42/1.01 |
| 2011/0088539 | A1 * | 4/2011 | Oz | 89/1.4 |
| 2011/0107642 | A1 * | 5/2011 | Godard | 42/71.01 |
| 2011/0154710 | A1 * | 6/2011 | Hatfield | 42/90 |
| 2012/0198744 | A1 * | 8/2012 | Meller et al. | 42/90 |
| 2014/0047753 | A1 * | 2/2014 | Grossman et al. | 42/72 |
| 2014/0298703 | A1 * | 10/2014 | Gale et al. | 42/71.02 |

* cited by examiner

*Primary Examiner* — Bret Hayes
*Assistant Examiner* — Derrick Morgan
(74) *Attorney, Agent, or Firm* — Albert Bordas, P.A.

(57) ABSTRACT

A wing and rider for firearms having a wing assembly. The wing assembly has an exterior face and an interior face defined by a top edge, a bottom edge, and first and second lateral edges. Protruding from the interior face is an insert shaped to fit into an opening of a firearm slide. The exterior face has a first predetermined width defined by the first and second lateral edges. Extending from the first and second lateral edges are first and second sidewalls having gripping means. The firearm slide has third and fourth sidewalls that define a second predetermined width. The first predetermined width is greater than the second predetermined width. The gripping means includes ridges, channels, protrusions, hatched sections, grooves, or any combination thereof. The wing and rider for firearms may further have a rider assembly configured and shaped to secure the firearm.

11 Claims, 5 Drawing Sheets

PRIOR ART

WING AND RIDER

BACKGROUND OF THE INVENTION

1. Field of the Invention

The present invention relates to firearm accessories, and more particularly, to firearm slide cover plate assemblies.

2. Description of the Related Art

Firearms are mostly utilized by law enforcement, sport enthusiasts, and private owners for target and game. While participating in sport or especially during moments of self-defense, it is desirable to manually cycle the firearm to load the firearm chamber with a cartridge for quick firing, and rapid succession. In most semi-automatic firearms that have an enclosed striker assembly, it is necessary to load the chamber, especially after inserting a magazine. However, prior art firearm slide cover plates cannot be grasped since they typically are flush and do not protrude from the firearm's slide.

There are no similar wing and riders with gripping means to the best of applicant's knowledge to facilitate manually cycling the firearm to load the firearm chamber, especially after inserting the magazine.

SUMMARY OF THE INVENTION

The present invention is a wing and rider for firearms, comprising a wing assembly. The wing assembly comprises an exterior face and an interior face defined by a top edge, a bottom edge, and first and second lateral edges. Protruding from the interior face is an insert cooperatively shaped to fit into an opening of a firearm slide as a cover plate. The exterior face has a first predetermined width defined by the first and second lateral edges. Extending from the first and second lateral edges are first and second sidewalls respectively. The first and second sidewalls comprise gripping means to facilitate grasping. The firearm slide comprises third and fourth sidewalls that define a second predetermined width. The first predetermined width defined by the first and second lateral edges is greater than the second predetermined width defined by the third and fourth sidewalls. The first and second sidewalls may be concavely or convexly shaped, or flat. The first and second sidewalls are each defined by tapered edges. The gripping means includes ridges, channels, protrusions, hatched sections, grooves, or any combination thereof.

In one embodiment, at least one of the first and second sidewalls extends to at least one elongated sidewall. The at least one elongated sidewall extends to an end. Extending from the end a predetermined distance towards the interior face, but without reaching the interior face, is a protrusion. The protrusion terminates at a protrusion edge. The protrusion is configured and shaped to secure onto the firearm slide. The at least one elongated sidewall extends towards a front end of the firearm slide without reaching the front end.

In another embodiment, the present invention further comprises a rider assembly, whereby at least one of the first and second sidewalls extends to an elongated arm. The elongated arm extends to a bridge. The bridge has a top edge, and may be convexly shaped. The bridge extends to a tension arm having a distal end. The rider assembly is configured and shaped to secure the firearm, whereby the tension arm comprises a tension force. The rider assembly extends towards a front end of the firearm slide without reaching the front end.

It is therefore one of the main objects of the present invention to provide a wing and rider to facilitate manually cycling a firearm to load the firearm chamber, especially after inserting a magazine.

It is another object of this invention to provide a wing and rider that provides additional gripping surfaces to facilitate a user to use additional force and leverage to operate a firearm slide.

It is another object of this invention to provide a wing and rider that provides additional gripping surfaces to facilitate a user to use additional force and leverage to operate a firearm slide, even when the firearm slide is covered with water or a slippery substance.

It is another object of this invention to provide a wing and rider that allows for a person with limited hand strength or a disability to operate a firearm slide.

It is another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
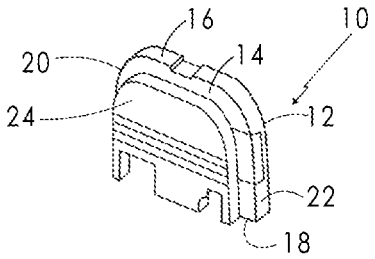
Fig. 1 PRIOR ART
FIG. 1 is an isometric view of a prior art slide cover plate.

Referring now to the drawings, it can be observed that the present invention basically includes wing assembly 50 and rider assembly 180.

Figure 2:
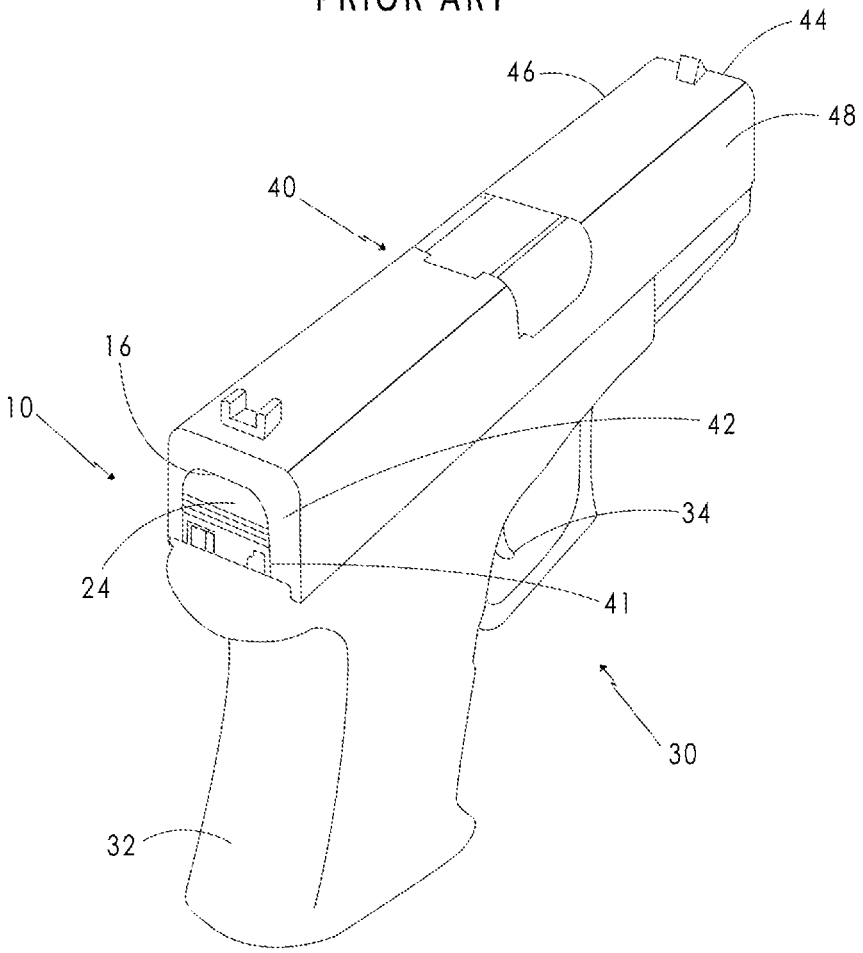
FIG. 2 is an isometric view of the prior art slide cover plate installed onto a firearm.

Seen in FIGS. 1 and 2 is prior art slide cover plate 10. Prior art slide cover plate 10 comprises interior wall 12 and exterior wall 14 defined by top edge 16, bottom edge 18, and lateral edges 20 and 22. Protruding from exterior wall 14 is exterior face 24 cooperatively shaped to fit into opening 41 of slide 40.

As seen in FIG. 2, firearm 30 comprises slide 40 that rides upon frame 32. Frame 32 has trigger 34. Slide 40 comprises rear end 42, front end 44, and sidewalls 46 and 48. Slide 40 has a predetermined width defined by sidewalls 46 and 48. Rear end 42 has opening 41 that receives prior art slide cover plate 10. In most semi-automatic firearms that have an enclosed striker assembly, as the one illustrated, it is necessary to load the firearm chamber, especially after inserting a magazine, not seen, whereby a predetermined force is required to manually cycle slide 40. However, prior art slide cover plate 10 cannot be grasped since it's flush with opening 41 and does not protrude from slide 40. If not able to overcome the predetermined force to manually cycle slide 40, firearm 30 is inoperable. It is noted that such a firearm 30 may be "GLOCK", without limitation to this specific brand.

Figure 3:
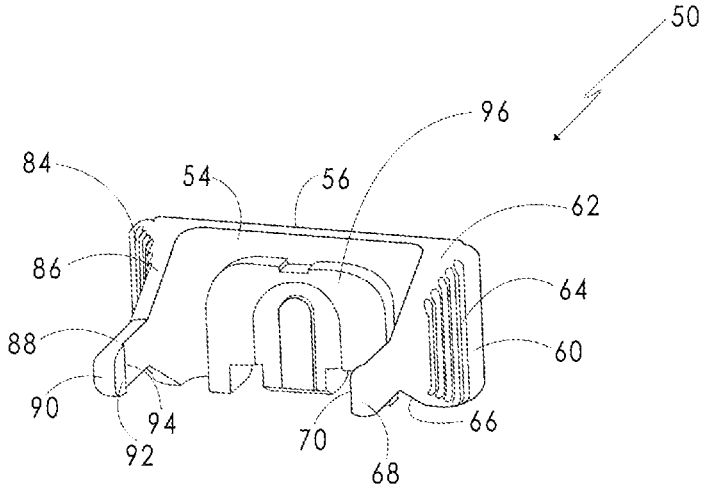
FIG. 3 is a first isometric view of the present invention.
Figure 4:
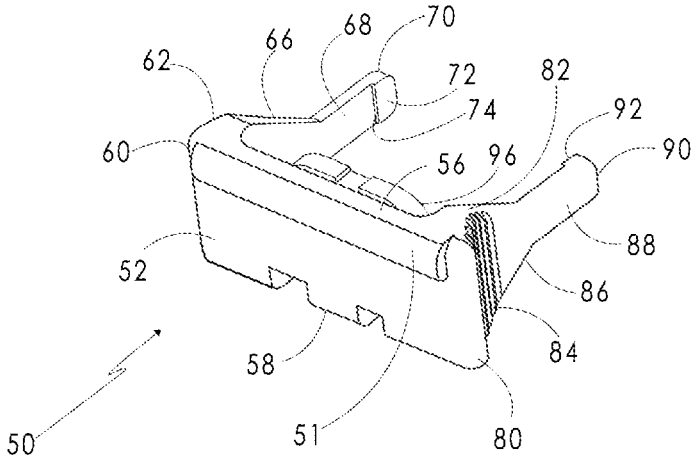
FIG. 4 is a second isometric view of the present invention.

Seen in FIGS. 3 and 4 is present invention 50. Present invention 50 comprises exterior face 52 and interior face 54 defined by top edge 56, bottom edge 58, and lateral edges 60 and 80. Protruding from exterior face 52, present invention 50 further comprises ridge 51. Ridge 51 serves to provide the user a forward assist in the event slide 40 fails to completely close, whereby the user applies a force thereon. Protruding from interior face 54 is insert 96 cooperatively shaped to fit into opening 41 of slide 40. Exterior face 52 has a predetermined width defined by lateral edges 60 and 80. Extending from lateral edge 60 is sidewall 62. In a preferred embodiment, sidewall 62 is concavely shaped and is defined by tapered edges 66 that extend to elongated sidewall 68. In an alternate embodiment, sidewall 62 is convexly shaped, or flat. Sidewall 62 comprises a textured surface as gripping means to facilitate grasping of the present invention, especially when manually cycling slide 40. Such gripping means includes, but is not limited to ridges 64, channels, protrusions, hatched sections, grooves, or any combination thereof to facilitate grasping of the present invention, especially when manually cycling slide 40. Elongated sidewall 68 extends to end 70. Extending from end 70 a first predetermined distance towards interior face 54, but without reaching interior face 54, is protrusion 72 that terminates at protrusion edge 74. Protrusion 72 is configured and shaped to secure onto sidewall 46 when the present invention is mounted upon firearm 30.

Similarly, extending from lateral edge 80 is sidewall 82. In a preferred embodiment, sidewall 82 is also concavely shaped and is defined by tapered edges 86 that extend to elongated sidewall 88. In an alternate embodiment, sidewall 82 is convexly shaped, or flat. Sidewall 82 also comprises gripping means to facilitate grasping of the present invention, especially when manually cycling slide 40. Such gripping means includes, but is not limited to ridges 84, channels, protrusions, hatched sections, grooves, or any combination thereof to facilitate grasping of the present invention, especially when manually cycling slide 40. Elongated sidewall 88 extends to end 90. Extending from end 90 a second predetermined distance towards interior face 54, but without reaching interior face 54, is protrusion 92 that terminates at protrusion edge 94. Protrusion 92 is configured and shaped to secure onto sidewall 48 when the present invention is mounted upon firearm 30. In a preferred embodiment, elongated sidewalls 68 and 88 are the same length, or approximately the same length, and the first and second predetermined distances are the same or approximately the same.

Figure 5:
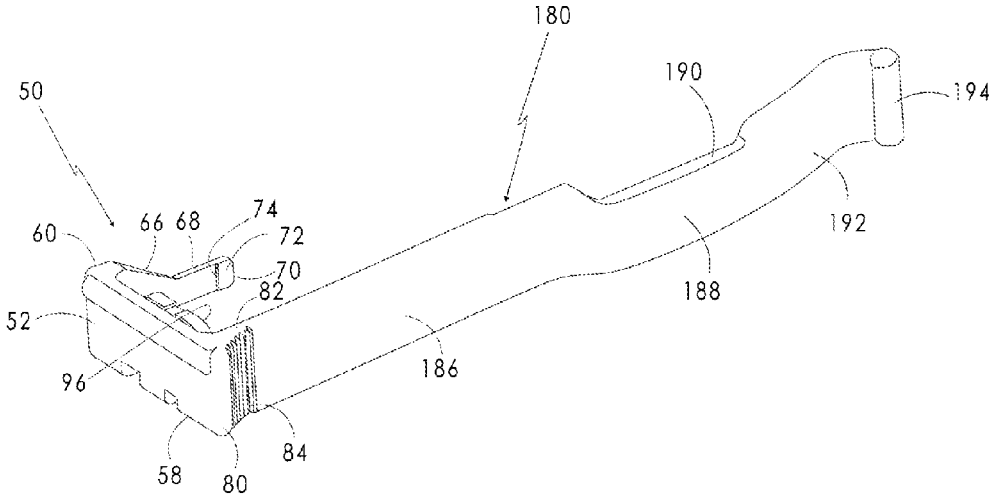
FIG. 5 is a first isometric view of an alternate embodiment of the present invention.
Figure 6:
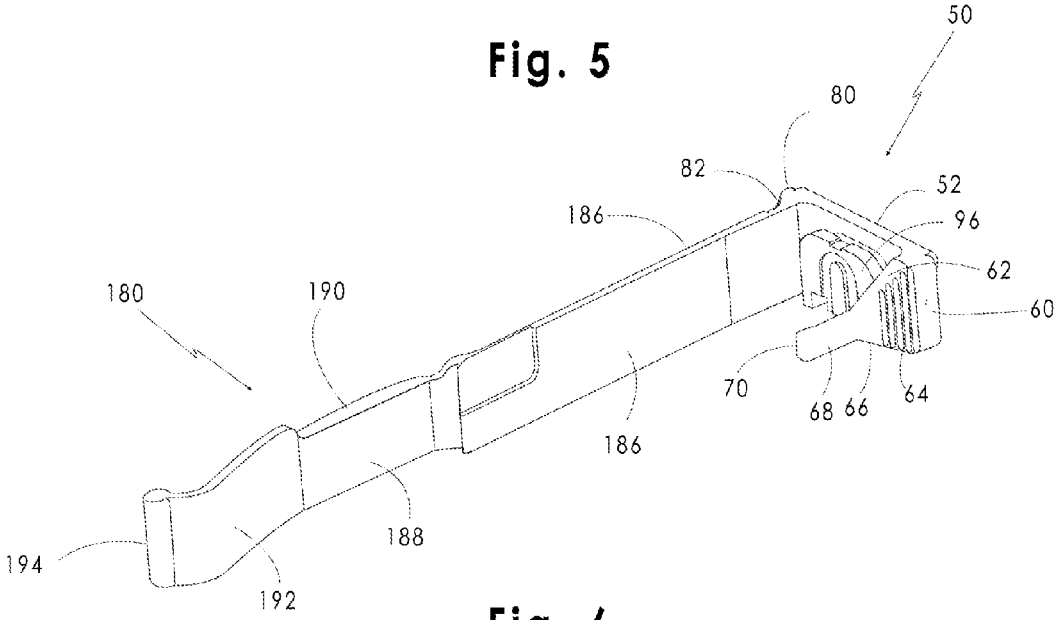
FIG. 6 is a second isometric view of the alternate embodiment of the present invention.

Seen in FIGS. 5 and 6 is an alternate embodiment of the present invention, whereby rider assembly 180 extends from either lateral edge 60 or 80. Extending from lateral edge 80 is sidewall 82. In a preferred embodiment, sidewall 82 is also concavely shaped, and for illustrative purposes, extends to elongated arm 186. In an alternate embodiment, sidewall 82 is convexly shaped, or flat. Sidewall 82 also comprises gripping means to facilitate grasping of the present invention when manually cycling slide 40. Such gripping means includes, but is not limited to ridges 84, channels, protrusions, hatched sections, grooves, or any combination thereof to facilitate grasping of the present invention, especially when manually cycling slide 40. Elongated arm 186 extends to bridge 188 having top edge 190. In a preferred embodiment, bridge 188 is convexly shaped and extends to tension arm 192 having distal end 194.

Figure 7:
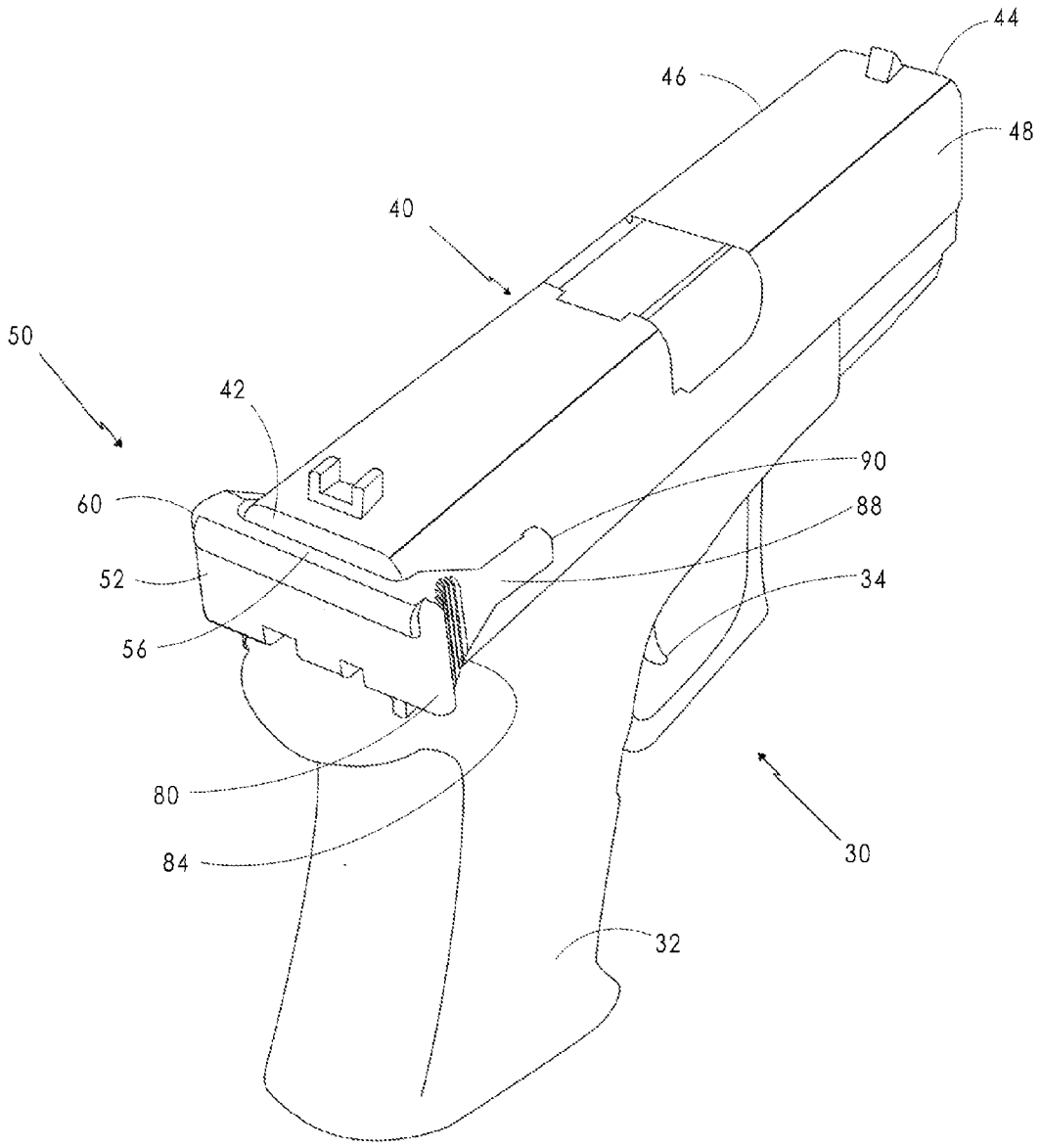
FIG. 7 is an isometric view of the present invention installed onto the firearm.
Figure 8:
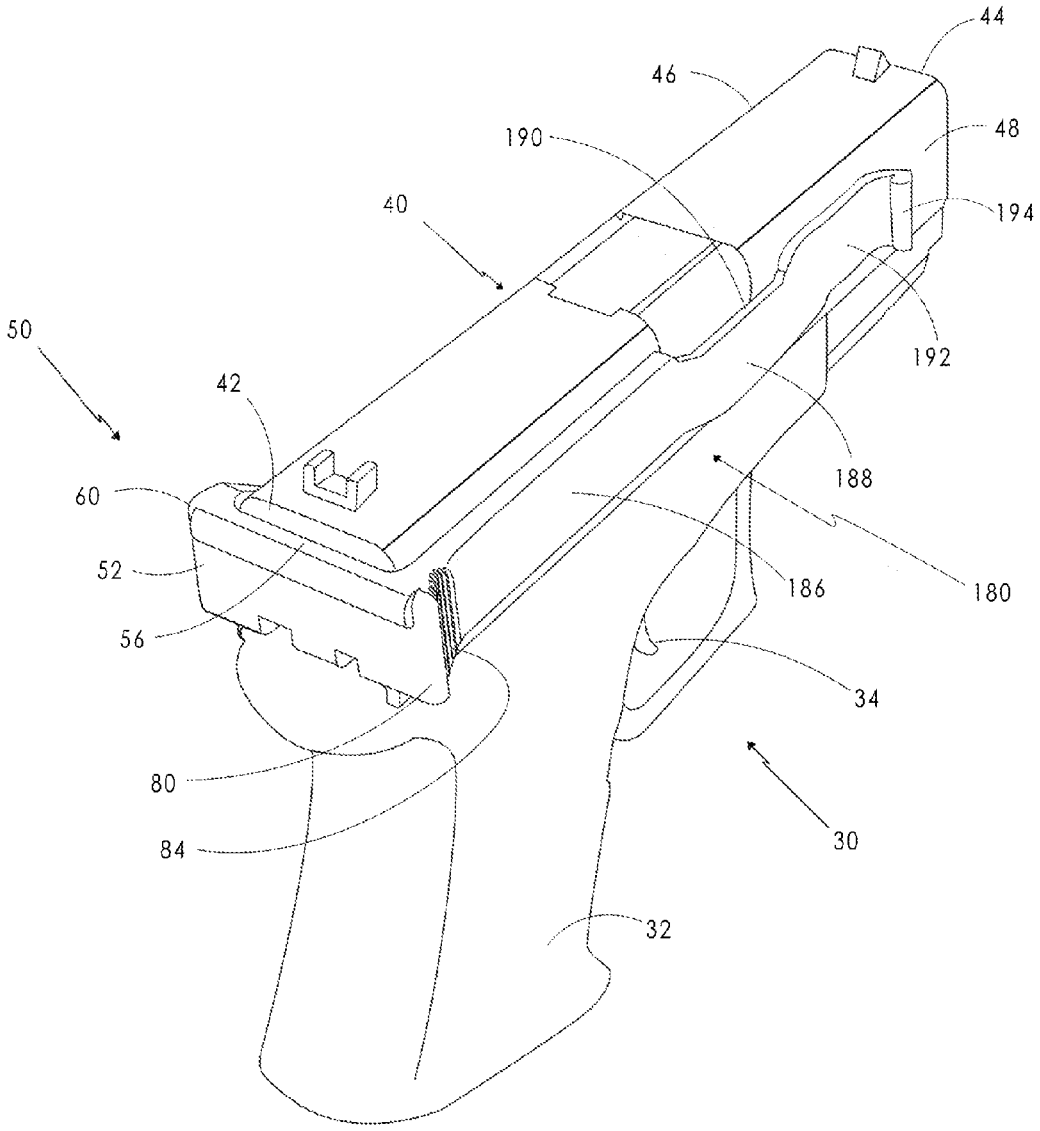
FIG. 8 is an isometric view of the alternate embodiment of the present invention installed onto the firearm.

As seen in FIGS. 7 and 8, present invention 50 is easy to grasp since it protrudes from opening 41 and also from slide 40, whereby the predetermined width defined by lateral edges 60 and 80 is greater than the predetermined width defined by sidewalls 46 and 48 of slide 40. Furthermore, elongated sidewalls 68 and 88 extend towards front end 44 without reaching front end 44.

As seen in FIG. 8, rider assembly 180 is configured and shaped to secure firearm 30, whereby rider assembly 180, and specifically tension arm 192 comprises a tension force. Similarly, the predetermined width defined by lateral edges 60 and 80 is greater than the predetermined width defined by sidewalls 46 and 48 of slide 40. Furthermore, elongated sidewall 68 and rider assembly 180 each extend towards front end 44 without reaching front end 44.

The present invention provides additional gripping surfaces, especially at sidewall 62 having ridges 64, to facilitate a user to use additional force and leverage to operate slide 40, even when slide 40 is covered with water or a slippery substance, and/or to clear a weapon malfunction. The present invention also allows for a person with limited hand strength or a disability to operate slide 40. The present invention is made out of a durable and light weight material as plastic, plastic composite, stainless steel, alloy metal, or other material having similar characteristics so as to cooperatively interact with slide 40 of semiautomatic firearms that have an enclosed striker assembly.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A wing and rider for firearms, comprising:

a wing assembly comprising an exterior face and an interior face defined by a top edge, a bottom edge, and first and second lateral edges, protruding from said interior face is an insert cooperatively shaped to fit into an opening of a firearm slide as a cover plate, said exterior face has a first predetermined width defined by said first and second lateral edges, extending from said first and second lateral edges are first and second sidewalls respectively, said first and second sidewalls comprise gripping means to facilitate grasping, said firearm slide comprises third and fourth sidewalls that define a second predetermined width, said first predetermined width defined by said first and second lateral edges is greater than said second predetermined width defined by said third and fourth sidewalls, said first and second sidewalls extend to respective first and second ends, said first and second sidewalls are defined by tapered edges which taper from said top and bottom edges toward said first and second ends of the first and second sidewalls respectively, extending from said first and second ends a predetermined distance towards said interior face are respective first and second protrusions, and protruding from said exterior face is a ridge.

2. The wing and rider for firearms set forth in claim 1, further characterized in that said first and second sidewalls are concavely shaped.

3. The wing and rider for firearms set forth in claim 1, further characterized in that said first and second sidewalls are convexly shaped or flat.

4. The wing and rider for firearms set forth in claim 1, further characterized in that said gripping means includes ridges, channels, protrusions, hatched sections, grooves, or any combination thereof.

5. The wing and rider for firearms set forth in claim 1, further characterized in that said first and second protrusions do not reach said interior face.

6. The wing and rider for firearms set forth in claim 5, further characterized in that each of said first and second protrusions terminates at respective first and second protrusion edges.

7. The wing and rider for firearms set forth in claim 5, further characterized in that said first and second protrusions are configured and shaped to secure onto said firearm slide.

8. The wing and rider for firearms set forth in claim 1, further characterized in that said first and second elongated sidewalls extend towards a front end of said firearm slide without reaching said front end.

9. The wing and rider for firearms set forth in claim 1, further characterized in that said ridge is continuous.

10. The wing and rider for firearms set forth in claim 9, further characterized in that said ridge extends from said first to second sidewalls.

11. The wing and rider for firearms set forth in claim 1, whereas said wing assembly, said insert, said first and second sidewalls, said first and second protrusions, and said ridge are all manufactured as a single piece.

* * * * *